United States Patent [19]

Shimotomai et al.

[11] Patent Number: 5,015,307

[45] Date of Patent: May 14, 1991

[54] CORROSION RESISTANT RARE EARTH METAL MAGNET

[75] Inventors: Michio Shimotomai; Yasutaka Fukuda; Akira Fujita, all of Chiba, Japan

[73] Assignee: Kawasaki Steel Corporation, Hyogo Pref., Japan

[21] Appl. No.: 251,366

[22] Filed: Sep. 30, 1988

[30] Foreign Application Priority Data

Oct. 8, 1987 [JP] Japan ..... 62-252320
Dec. 23, 1987 [JP] Japan ..... 62-323804

[51] Int. Cl.[5] ..... H01F 1/053
[52] U.S. Cl. ..... 148/302; 148/121
[58] Field of Search ..... 148/302; 420/83, 121, 420/95, 119

[56] References Cited

U.S. PATENT DOCUMENTS 4,496,395 1/1985 Croat ..... 148/301
4,597,938 7/1986 Matsuura et al. ..... 419/23
4,792,368 12/1988 Sagawa et al. ..... 148/302
4,802,931 2/1989 Croat ..... 148/302
4,851,058 7/1989 Croat ..... 148/302

FOREIGN PATENT DOCUMENTS 61-48904 6/1966 Japan .
60-27105 6/1985 Japan .
61-123119 6/1986 Japan ..... 148/302

*Primary Examiner*—John P. Sheehan
*Attorney, Agent, or Firm*—Parkhurst, Wendel & Rossi

[57] ABSTRACT

A corrosion-resistant rare earth metal-transition metal magnet alloy having excellent coercive force, squareness, corrosion resistance and temperature characteristics is disclosed, which alloy consists of at least one of rare earth element inclusive of Y; B; occasionally at least one of Mg, Al, Si, Ca, Ti, V, Cr, Mn, Cu, Zn, Ga, Ge, Zr, Nb, Mo, In, Sn, Ta and W; and the remainder being transition metals of Fe, Co and Ni.

4 Claims, 5 Drawing Sheets

CORROSION RESISTANT RARE EARTH METAL MAGNET

BACKGROUND OF THE INVENTION (1) Field of the Invention

This invention relates to a corrosion resistant rare earth metal magnet, and more particularly relates to a rare earth metal-transition metal type magnet alloy having excellent coercive force and squareness and further having excellent corrosion resistance and temperature characteristics. The term "rare earth metal" used herein means Y and lanthanoid.

(2) Related Art Statement

Typical permanent magnets produced at the present time are alnico magnets, ferrite magnets, rare earth metal magnets and the like. The alnico magnet has been predominantly used for a long period of time in the magnet material field. However, the demand for the alnico magnet is recently decreasing due to the temporary rising of the price of cobalt, contained as one component in the alnico magnet, in the past because of its short supply and also due to the developments of inexpensive ferrite magnets and rare earth metal magnets having magnetic properties superior to those of alnico magnets. As for the ferrite magnet, it consists mainly of iron oxide and is consequently inexpensive and chemically stable. Therefore, the ferrite magnet is predominantly used at present, but it has a drawback that the ferrite magnet is small in maximum energy product.

There has been proposed an Sm-Co type magnet which is featured by both the magnetic anisotropy inherent to rare earth metal ions and the magnetic moment inherent to transition metals and has a maximum energy product remarkably larger than that of conventional magnets. However, the Sm-Co type magnet consists mainly of Sm and Co which are considered scarce natural resources, and therefore the Sm-Co type magnet is expensive.

In order to eliminate the drawbacks of the Sm-Co type magnet, it has been attempted to develop an inexpensive magnet alloy which does not contain expensive Sm and Co, but has excellent magnetic properties. Sagawa et al disclose ternary stable magnet alloys produced through a powder-sinter method in Japanese Patent Application Publication No. 61-34,242 and Japanese Patent Laid-open Application No. 59-132,104. J. J. Croat et al disclose a magnet alloy having high coercive force through a melt-spinning method in Japanese Patent Laid-open Application No. 59-64,739. These magnet alloys are Nd-Fe-B ternary alloys. Among them, the Nd-Fe-B magnet alloy produced through a powder-sinter method has a maximum energy product higher than that of the Sm-Co type magnet.

However, the Nd-Fe-B type magnet contains large amounts of reactive light rare earth metals, such as Nd and the like, and easily corrodible Fe as components. Therefore, the Nd-Fe-B type magnet is poor in corrosion resistance, and hence the magnet is deteriorated in its magnetic properties with the lapse of time, and is poor in reliability as an industrial material.

In general, in order to improve the corrosion resistance of the Nd-Fe-B type magnet, the sintered type magnet is subjected to a surface treatment, such as plating, coating or the like, while the resin-bonded type magnet is made from magnet powder subjected to surface treatment before its kneading together with resin powder. However, these anti-rust treatments cannot give an anti-rust effect durable for a long period of time to a magnet, and moreover the resulting magnet is expensive due to the necessity of the anti-rust treatment. Further, there is a loss of magnetic flux in the magnet due to the thick protective film. Therefore, conventional Nd-Fe-B type magnets have not hitherto been widely used due to these drawbacks.

In addition to such a drawback, the Nd-Fe-B type magnet is poor in temperature characteristics due to its low Curie temperature of about 300° C. For example, the Nd-Fe-B type magnet has a reversible temperature coefficient of residual magnetic flux density of −0.12−−0.19(%/°C.), and is noticeably inferior to the Sm-Co type magnet having a Curie temperature of 700° C. or higher and a reversible temperature coefficient of residual magnetic flux density of −0.03−−0.04(%/°C.). Accordingly, the Nd-Fe-B type magnet must be used at a lower temperature range compared to the Sm-Co type magnet and under an environment which does not oxidize and corrode the magnet, in order to satisfactorily utilize its excellent magnetic properties. That is, the use field of the Nd-Fe-B type magnet has hitherto been limited to a narrow range.

The present invention advantageously solves the above described problems and provides a rare earth metal-transition metal type magnet alloy having not only excellent magnetic properties but also excellent temperature characteristics and corrosion resistance.

The present invention is based on the results of the following studies.

There are two methods for improving the corrosion resistance of alloy. In one of the methods, a shaped body of the alloy is subjected to a surface treatment, such as plating, coating or the like, in order not to expose the shaped body to a corrosive and oxidizing atmosphere. In the other method, a metal element which acts to enhance the corrosion resistance of the resulting alloy is used. In the former method, additional treating steps for the surface treatment must be carried out in the production process, and hence the resulting alloy is expensive. Moreover, when the alloy surface is once broken, the alloy is corroded from the broken portion, and the alloy shaped body is fatally damaged due to the absence of countermeasures against the spread of the corrosion at present. While, in the latter method, the resulting alloy itself has a corrosion resistance, and hence it is not necessary to carry out the surface treatment of the resulting alloy. As the metal element which acts to enhance the corrosion resistance of an alloy by alloying, there can be used Cr, Ni and the like. When Cr is used, the resulting alloy is always poor in magnetic properties, particularly in residual magnetic flux density. While, the use of a ferromagnetic metal of Ni can be expected to improve the corrosion resistance of the resulting alloy without noticeably deteriorating its residual magnetic flux density.

The inventors have found out that, when at least 20% of Fe in an Nd-Fe-B magnet is replaced by Ni, the corrosion resistance of the magnet is remarkably improved, but the coercive force of the magnet is concurrently noticeably deteriorated. That is, even when the corrosion resistance of a magnet is improved, if the magnetic properties, which are the most important properties, of the magnet are deteriorated, the magnet can not be used for practical purposes.

The inventors have further made various investigations in order to improve the corrosion resistance and temperature characteristics of an Nd-Fe-B type magnet without deteriorating the magnetic properties demanded to the magnet as fundamental properties, and have found out that, when Ni is contained together with Co in an Nd-Fe-B magnet, that is, when a part of Fe in an Nd-Fe-B magnet is replaced by given amounts of Ni and Co, the above described object can be attained. The present invention is based on this discovery.

SUMMARY OF THE INVENTION

The feature of the present invention lies in a corrosion-resistant rare earth metal-transition metal magnet alloy having a composition consisting of 10–25 at % of RE, wherein RE represents at least one metal selected from the group consisting of the rare earth elements inclusive of Y; 2–20 at % of B; occasionally not more than 8 at % of at least one metal selected from the group consisting of Mg, Al, Si Ca, Ti, V, Cr, Mn, Cu, Zn, Ga, Ge, Zr, Nb, Mo, In, Sn, Ta and W; and the remainder being transition metals of Fe, Co and Ni in such amounts that the amount of Fe is not less than 10 at % but less than 73 at %, that of Co is 7–50 at %, that of Ni is 5–30 at %, and the total amount of Fe, Co and Ni is not less than 55 at % but less than 88 at %, wherein a ratio of (Co+Ni) at %/(Fe+Co+Ni) at % is more than about 40%.

DESCRIPTION OF THE PREFERRED EMBODIMENT

Figure 1:
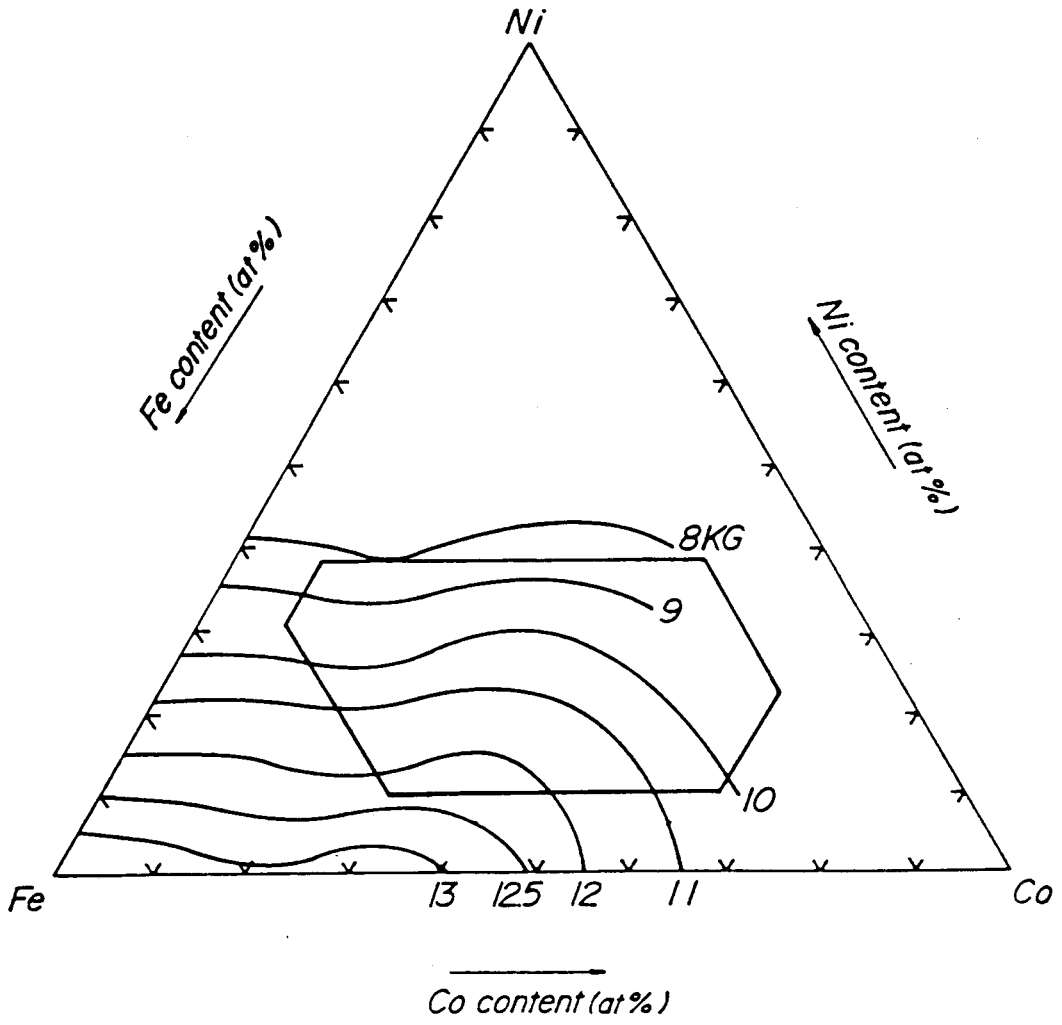
FIG. 1 is a ternary diagram illustrating a relationship between the ratio of transition metals of Fe, Co and Ni in a sintered body magnet having a composition consisting of Nd: 15 at % (hereinafter, "at %" may be represented merely by "%"), transition metals: 77% and B: 8%, and the saturation magnetization $4\pi Ms$ of the magnet.

The present invention will be explained in more detail.

An explanation will be made with respect to the reason for the limitation of the composition of the RE-(Fe,Co,Ni)-B alloy magnet of the present invention to the above described range.

RE (Y and lanthanoid): 10–25%

RE, that is, rare earth metal, is an essential element for the formation of the main phase ($Nd_2Fe_{14}B$ tetragonal system) and for the development of a large magnetocrystalline anisotropy in the alloy. When the RE content in the RE-(Fe,Co,Ni)-B alloy of the present invention is less than 10%, the effect of RE is poor. While, when the RE content exceeds 25%, the alloy is low in the residual magnetic flux density. Therefore, RE is contained in the RE-(Fe,Co,Ni)-B alloy of the present invention in an amount within the range of 10–25% in either case where RE is used alone or in admixture.

B: 2–20%

B is an essential element for the formation of the crystal structure of the main phase in the alloy. However, when the B content in the alloy is less than 2%, the effect of B for formation of the main phase is poor. While, when the B content exceeds 20%, the alloy is low in the residual magnetic flux density. Therefore, the B content in the RE-(Fe,Co,Ni)-B alloy of the present invention is limited to an amount within the range of 2–20%.

Fe: not less than 10% but less than 73%

Fe is an essential element for forming the main phase of the alloy and for obtaining the high saturated magnetic flux density of the alloy. When the Fe content is less than 10%, the effect of Fe is poor. While, when the Fe content is 73% or more, the content of other components is relatively decreased, and the alloy is poor in the coercive force. Therefore, the Fe content in the RE-(Fe,Co,Ni)-B alloy of the present invention is limited to an amount within the range of not less than 10% but less than 73%.

Ni: 5–30% and Co: 7–50%

Ni and Co are added to an Nd-Fe-B type alloy by replacing a part of Fe by Ni and Co, and act to form the main phase of the resulting RE-(Fe,Co,Ni)-B alloy of the present invention. Ni is effective for improving the corrosion resistance of the Nd-Fe-B type alloy. When the Ni content in the RE-(Fe,Co,Ni)-B alloy is less than 5%, the effect of Ni is poor. While, when the Ni content in the alloy exceeds 30%, the alloy is very low in the coercive force and in the residual magnetic flux density. Therefore, Ni must be contained in the RE-(Fe,Co,Ni)-B alloy of the present invention in an amount within the range of 5–30%, preferably 10–18%.

Co is effective for improving the magnetic properties, particularly coercive force, of the Nd-Fe-B type alloy without an adverse influence upon the effect of Ni for improving the corrosion resistance of the alloy, and is further effective for raising the Curie temperature of the alloy, that is, for improving the temperature characteristics of the alloy. However, when the Co content in the RE-(Fe,Co,Ni)-B alloy of the present invention is less than 7%, the effect of Co is poor. While, when the Co content in the alloy exceeds 50%, the alloy is low in the coercive force and in the residual magnetic flux density. Therefore, Co is contained in the alloy in an amount within the range of 7–50%.

In the RE-(Fe,Co,Ni)-B alloy of the present invention, the effect of Ni and Co for improving the magnetic properties and corrosion resistance of the Nd-Fe-B type alloy by the replacement of a part of Fe by Ni and Co in the present invention is not developed by merely the arithmetical addition of the individual effects of Ni and Co, but is developed by the synergistic effect of Ni and Co in the combination use of the above described proper amounts. This effect will be explained in detail hereinafter.

Figure 2:
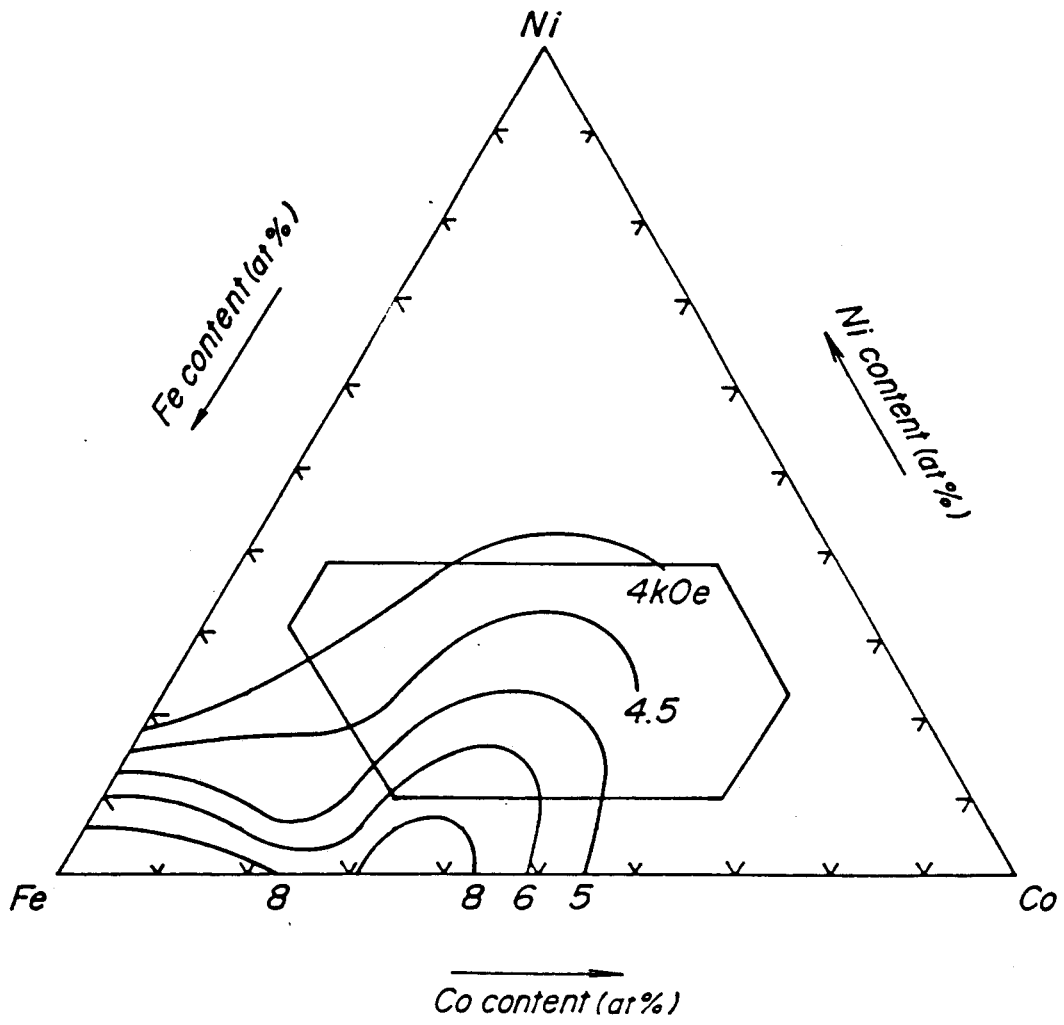
FIG. 2 is a ternary diagram illustrating a relationship between the ratio of transition metals of Fe, Co and Ni in a sintered body magnet having a composition consisting of Nd: 15%, transition metals: 77% and B: 8%, and the coercive force iHc of the magnet.
Figure 3:
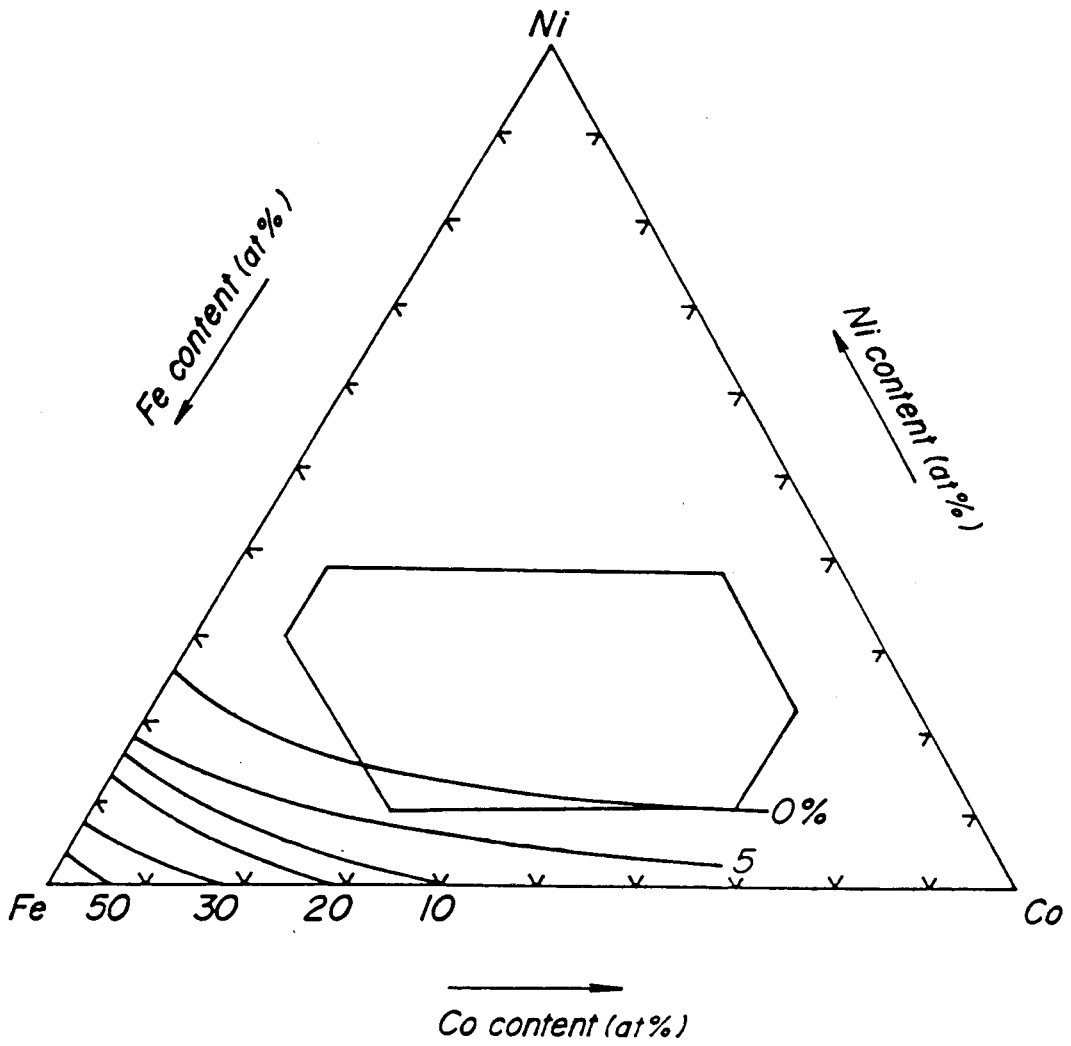
FIG. 3 is a ternary diagram illustrating a relation between the ratio of transition metals of Fe, Co and Ni in a sintered body magnet having a composition consisting of Nd: 15%, transition metals: 77% and B: 8%, and the rusty surface area fraction of the magnet after the magnet has been left to stand for 48 hours under a corrosive environment (air temperature: 70° C., and humidity: 95%).

FIGS. 1, 2 and 3 are Fe-Co-Ni ternary diagrams illustrating the results of the investigations of the saturation magnetization $4\pi Ms$(kG), coercive force iHc(kOe) and rusty area fraction (rusty surface area fraction, %), respectively, in an Nd-(transition metal component)-B alloy sample produced through a powder-sinter method and having a composition of Nd: (transition metal component): B of 15:77:8 in an atomic ratio in percentage, whose transition metal component consists of various atomic ratios in percentage of Fe, Co and Ni.

The proper ranges of the amounts of Fe, Co and Ni in the RE-(Fe,Co,Ni)-B alloy of the present invention lies within the range surrounded by the thick solid lines in FIGS. 1-3 in the case where the alloy has the above described composition of $Nd_{15}(Fe,Co,Ni)_{77}B_8$.

It can be seen from FIG. 1 that, when a part of Fe is replaced by Ni and Co, the value of saturation magnetization of an RE-(Fe,Co,Ni) B alloy is not monotonously decreased in proportion to the concentrations of Ni and Co, but the range, within which the alloy has a saturation magnetization value high enough to be used practically as a magnet having a saturation magnetization value of $4\pi Ms \geqq 8$ kG, is increased by the effect of the combination use of Ni and Co.

In the result of the investigation with respect to the coercive force illustrated in FIG. 2, the effect of the combination use of Ni and Co is more significant, and it can be seen that alloys formed by replacing Fe by 30-50% of Co and 0-20% of Ni have a large coercive force. Hitherto, the alloys are known to have a large coercive force only at the corner area of Fe in the ternary diagram.

The test results of the rusty area fraction of $Nd_{15}(Fe,Co,Ni)_{77}B_8$ alloy samples illustrated in FIG. 3 are as follows. The rusty area fraction is not decreased to zero until not less than 25% of Fe is replaced by Ni alone. However, although Co is not so effective as Ni, Co also has a rust-preventing effect, and when Ni is used in combination with Co, the concentration of Ni, which makes zero the rusty area fraction, can be decreased. When the resulting RE-(Fe,Co,Ni)-B alloy has a rusty area fraction of 5% or less, the alloy can be used for practical purpose without troubles.

Based on the above described reason, the Ni content in the RE-(Fe-Co-Ni)-B alloy of the present invention is limited to 5-30%, and the Co content is limited to 7-50%.

(Fe+Ni+Co): not less than 55% but less than 88%

The total amount of transition metals of Fe, Ni and Co should be determined depending upon the amount of rare earth metal. When the amount of the transition metals is large, the amount of rare earth metal is inevitably small, and a phase consisting of transition metals and boron is formed, which results in an alloy having a very low coercive force. While, when the amount of the transition metals is small, a non-magnetic phase containing a large amount of rare earth metal occupies in a large amount, resulting in poor residual magnetic flux density. Therefore, the total amount of Fe, Ni and Co must be within the range of not less than 55% but less than 88% under a condition that the amount of each of Fe, Ni and Co lies within the above described proper range. At least one metal selected from the group consisting of Mg, Al, Si, Ca, Ti, V, Cr, Mn, Cu, Zn, Ga, Ge, Zr, Nb, Mo, In, Sn, Ta and W: not more than 8%

These metals are effective for improving the coercive force and squareness of the RE-(Fe,Co,Ni)-B magnet of the present invention, and are indispensable for obtaining a high energy product $(BH)_{max}$ in the magnet. However, when the total amount of these metals exceeds 8%, the effect of these metals for improving the coercive force and squareness of the RE-(Fe,Co,Ni)-B magnet is saturated, and further the residual magnetic flux density of the magnet is lowered, and hence the magnet has a low maximum energy product $(BH)_{max}$. Therefore, these metals are used alone or in admixture in an amount within the range of not more than 8%.

The method for producing the rare earth metal-transition metal alloy magnet according to the present invention will be explained hereinafter.

As the method for producing the rare earth metal-transition metal alloy magnet of the present invention, there can be used a powder-sinter method and a melt-spinning method. Among them, in the powder-sinter method, an ingot of magnet alloy is finely pulverized into particles of about several μm in size, the finely pulverized magnetic powders are pressed under pressure while aligning the powders in a magnetic field, and the shaped body is sintered and then heat treated to obtain the aimed magnet. In this method, an anisotropic magnet is obtained. Moreover, in this method, the sintered shaped body is heat treated to form a microstructure which prevents the moving of magnetic domain, or a microstructure which suppresses the development of adverse magnetic domain, whereby the coercive force of the magnet is enhanced.

While, in the melt-spinning method, a magnet alloy is induction-melted in a tube, and the melted alloy is jetted through an orifice on a rotating wheel to solidify the alloy rapidly, whereby a thin strip having a very fine microstructure is obtained. In addition, the resulting thin strip can be formed into a resin-bonded type magnet (or plastic magnet) by a method, wherein the thin strip is pulverized, the resulting powders are kneaded together with resin powders, and the homogeneous mixture is molded. However, in this case, the magnet powders consist of fine crystals having easy magnetization axes directed randomly, and hence the resulting magnet body is isotropic.

Among the magnet alloys having a composition defined in the present invention, the anisotropic sintered magnetic body has a maximum energy product which is higher than that of a ferrite magnet and is the same as that of an Sm-Co magnet, and further has the corrosion resistance equal to that of an Sm-Co magnet. The isotropic resin-bonded type magnet has a maximum energy product of at least 4 MGOe and is corrosion-resistant, and therefore is small in the deterioration of magnetic properties due to corrosion.

The reason why an alloy having excellent magnetic properties and further excellent corrosion resistance and temperature characteristics can be obtained by replacing a part of Fe in an RE-Fe-B type alloy by proper amounts of Ni and Co according to the present invention, is not yet clear, but is probably as follows.

The ferromagnetic crystalline phase of the RE-(Fe,Co,Ni)-B alloy according to the present invention probably has the same tetragonal structure as that of $Nd_2Fe_{14}B$ phase, whose Fe has partly been replaced by Ni and Co. The $Nd_2Fe_{14}B$ phase has been first indicated in the year of 1979 (N. F. Chaban et al, Dopov, Akad. Nauk, SSSR, Set. A., Fiz-Mat. Tekh. Nauki No. 10 (1979), 873), and its composition and crystal structure have been clearly determined later by the neutron diffraction (J. F. Herbst et al, Phys. Rev. B 29 (1984), 4176).

Figure 4:
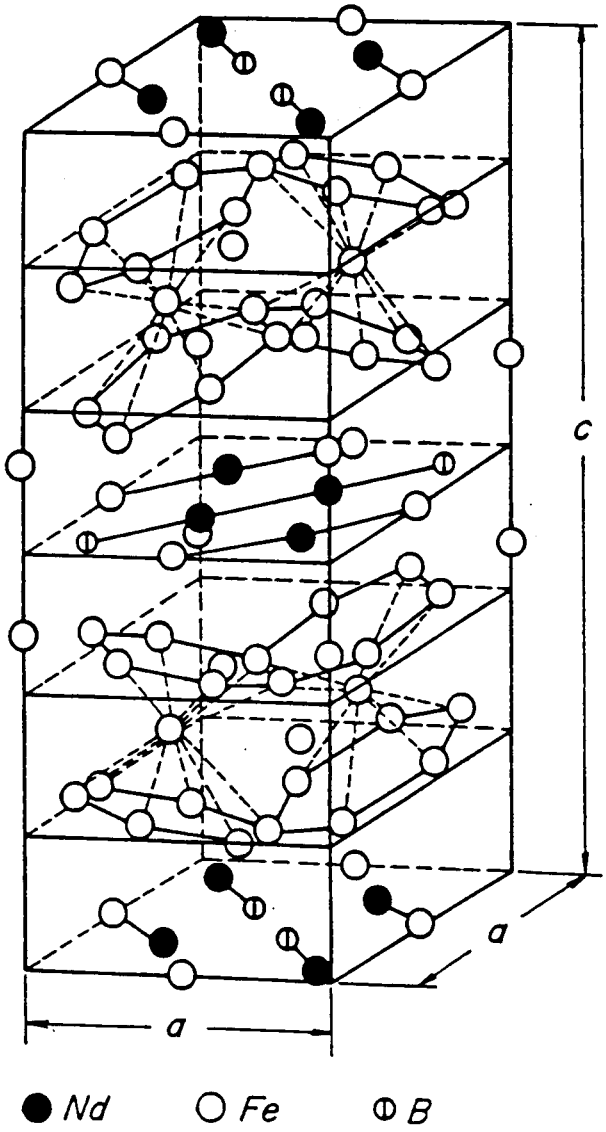
FIG. 4 is a view of a model illustrating the arrangement of atoms in the crystal structure of $Nd_2Fe_{14}B$, which is the main phase of an Nd-Fe-B type alloy.

FIG. 4 illustrates the arrangement of atoms in a unit cell of the $Nd_2F_{14}B$ phase. It can be seen from FIG. 4 that the $Nd_2Fe_{14}B$ phase has a layered structure ConSiSting of a layer consisting of Nd, Fe and B atoms and a layer formed by Fe atoms compactly arranged. In such a crystal structure, magnetic properties are determined by two contributions, one from an Nd sublattice and the other from an Fe sublattice. In the Nd sublattice, a magnetic moment is formed by *4f* electrons locally present in the Nd ion. While, in the Fe sublattice, a magnetic moment is formed by itinerant *3d* electrons. These magnetic moments are mutually ferromagnetically coupled to form a large magnetic moment. It is known that, in Fe metal, Fe has a magnetic moment of 2.18 Bohr magneton units per 1 atom at room temperature. In Co metal, Co has a magnetic moment of 1.70 Bohr magneton units per 1 atom at room temperature. In Ni metal, Ni has a magnetic moment of 0.65 Bohr magneton unit per 1 atom at room temperature. That is, the magnetic moment of Co or Ni atom is smaller than the magnetic moment of Fe atom, and therefore if these magnetic moments are locally present in the respective atoms, the saturated magnetic flux density of the alloy ought to be diminished according to the law of arithmetical addition by the replacement of Fe by Ni and Co. However, in the above described layer consisting of Fe atoms, the above described phenomenon wherein a large saturation magnetization is observed, can not be explained by a model wherein the magnetic moment is locally present in an atom, but can be explained by an itinerant electron model. That is, when Fe is replaced by Ni and Co, the density of states and the Fermi level of the Fe sublattice are changed, and as the result, the magnetic moment of the sublattice, now composed of Fe, Co and Ni, becomes large in an amount larger than the value, which is anticipated according to the law of arithmetical addition by the replacement of Fe by Ni and Co, in a specifically limited substituted composition range. Further, the corrosion resistance of the alloy is probably increased by the change of the oxidation-reduction potential of the alloy due to the change of electronic property thereof. Further, Ni and Co have such an effect that a part of each of the added Ni and Co is segregated in the grain boundary to improve the corrosion resistance of the alloy.

The magnetocrystalline anisotropy of the alloy of the present invention, which has an influence upon its coercive force, is composed of two components, one due to the RE ions and the other due to the Fe sublattice. The component due to the Fe sublattice is changed by replacing partly e by Ni and Co. It can be expected that Ni and Co do not go randomly into the sublattice of Fe, but go selectively into non-equivalent various sites of Fe, whereby the magnetocrystalline anisotropy of Fe sublattice is enhanced within the specifically limited composition ranges of Ni and Co.

The improvement of the temperature characteristics of the alloy of the present invention is probably as follows. It is commonly known that Co acts to raise the Curie temperature of iron alloy. The same mechanism works to raise the Curie temperature of the alloy of the present invention. It is probable that, when Ni is used in combination with Co, the Curie temperature of the Nd-(Fe,Co,Ni)-B alloy is slightly raised.

In general, in the case where a component metal of a magnet alloy is replaced by other metal, when the replaced amount is as large as enough to enhance the corrosion resistance and temperature characteristics of the alloy, the magnetic properties of the alloy is noticeably deteriorated. While, when the replaced amount is small so as not to deteriorate the magnetic properties, the corrosion resistance and temperature characteristics of the alloy can not be improved. Accordingly, it is difficult to find out a composition of an alloy which can satisfy all the requirements of corrosion resistance, temperature characteristics and magnetic properties.

However, according to the present invention, Fe in an RE-Fe-B alloy is replaced by a combination of specifically limited amounts of Ni and Co, whereby the corrosion resistance of the alloy is improved without substantially deteriorating the magnetic properties.

Further, when at least one metal selected from the group consisting of Mg, Al, Si, Ca, Ti, V, Cr, Mn, Cu, Zn, Ga, Ge, Zr, Nb, In, Sn, Ta, W and the like, is added to the RE-(Fe,Co,Ni)-B alloy of the present invention, the coercive force and squareness of the RE-(Fe,Co,Ni)-B alloy are improved. The reason is probably as follows. When these metals are added to an RE-(Fe,Co,Ni)-B alloy, the anisotropy field is increased, or the distribution of component metals and the microstructure and the like are varied. As the result, the development of reverse magnetic domain is suppressed or the movement of magnetic domain walls is obstructed, whereby the coercive force and squareness of the alloy are improved.

The following examples are given for the purpose of illustration of this invention and are not intended as limitations thereof.

EXAMPLE 1

Figure 5:
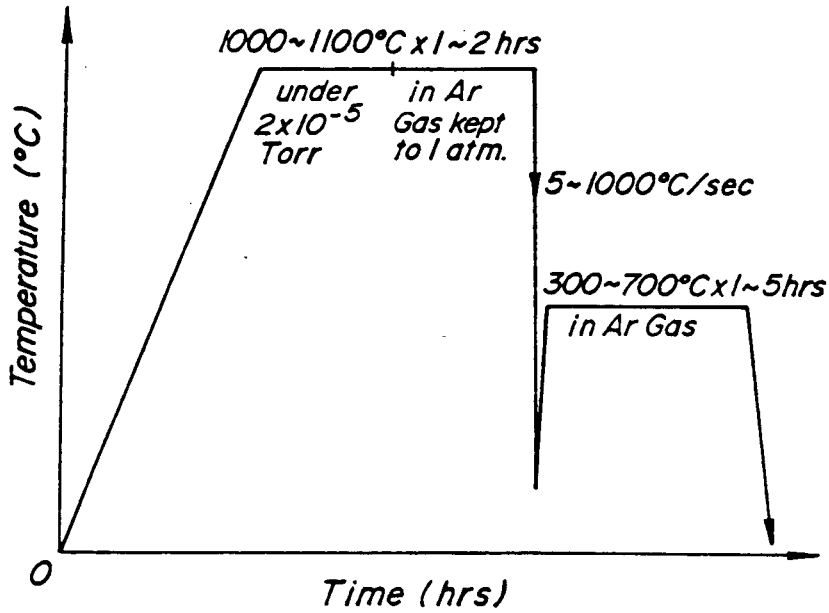
FIG. 5 is a diagram illustrating a heat pattern of the treatment in Example 1.

Alloy ingots having compositions illustrated in the following Table 1 were produced by an arc melting method, and each of the ingots was roughly crushed by means of a stamp mill, and then finely divided into a particle size of about 2–4 μm by means of a jet mill. The resulting fine powder was press molded into a shaped body under a pressure of 2 tons/cm$^2$ in a magnetic field of 12.5 kOe, the shaped body was sintered at 1,000°–1,100° C. for 1 hour under a vacuum of about $2\times10^{-5}$ Torr and further sintered at 1,000°–1,100° C. for 1 hour under an Ar atmosphere kept to 1 atmospheric pressure, and the sintered body was rapidly cooled by blowing Ar gas thereto. Thereafter, the rapidly cooled sintered body was subjected to an ageing treatment, wherein the sintered body was kept for 1–5 hours at a temperature of 300°–700° C. under an Ar gas atmosphere, and then rapidly cooled. FIG. 5 illustrates the heat pattern in the above described treatments.

Each of the resulting samples was magnetized by a pulsed magnetic field and the magnetized sample was tested with respect to its residual magnetic flux density Br, coercive force iHc, maximum energy product $(BH)_{max}$, squareness, temperature coefficient $\Delta B/B$ of residual magnetic flux density and corrosion resistance.

The corrosion resistance of the sample is shown by its weight increase (%) due to oxidation in a treatment, wherein the sample is left to stand for 1,000 hours under a corrosive environment of an air temperature of 70° C. and a humidity of 95%.

Figure 6:
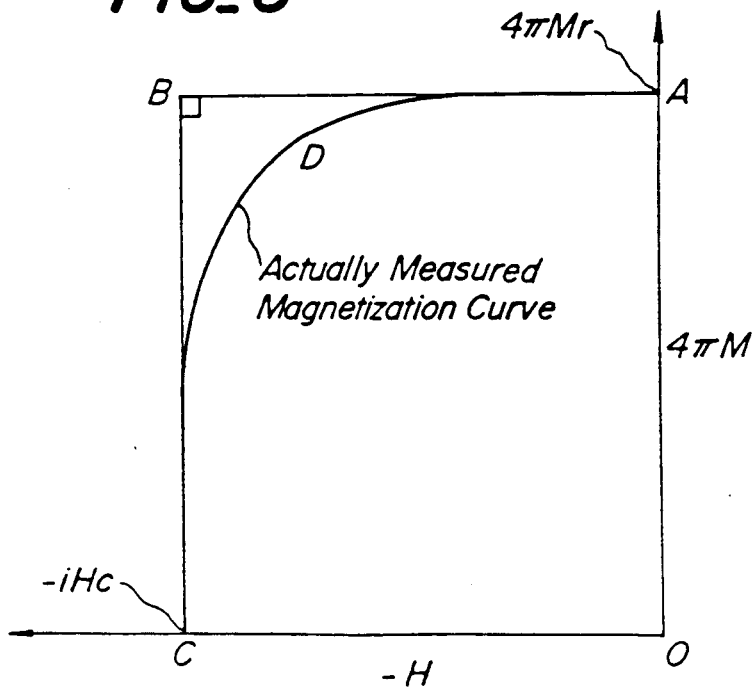
FIG. 6 is an explanative magnetization curve in its second quadrant of hysteresis, which curve is used for the calculation of the squareness ratio SR of magnets in Example 1.

The squareness of the sample is shown by the squareness ratio SR in the second quadrant of the magnetization curve illustrated in FIG. 6, which ratio is defined by the following equation:

$$SR = \frac{\text{Area of sector } ADCO}{\text{Area of rectangle } ABCO} \times 100(\%)$$

The test results are shown in Table 1.

It can be seen from Table 1 that all the magnet alloys (Sample Nos. 1-75) according to the present invention have excellent magnetic properties and further excellent temperature characteristics and corrosion resistance.

TABLE 1

| | Composition (at %) | | | | | | Magnetic properties | | | | | Oxidation |
|---|---|---|---|---|---|---|---|---|---|---|---|---|
| | RE | Fe | Co | Ni | B | Additional metal | Br (kG) | iHc (kOe) | (BH) max (MGOe) | SR (%) | ΔB/B (%/°C.) | increase (mg/cm²) |
| Sample No. 3 (this invention) | Nd 14 | 39 | 30 | 9 | 8 | — | 12.2 | 5.8 | 32.0 | 91 | −0.04 | 0.01 |
| Sample No. 4 (this invention) | Nd 15 | 27 | 40 | 10 | 8 | — | 12.3 | 7.5 | 32.0 | 90 | −0.04 | 0.01 |
| Sample No. 5 (this invention) | Nd 15 | 17 | 50 | 10 | 8 | — | 11.5 | 5.5 | 30.0 | 92 | −0.03 | 0.01 |
| Sample No. 6 (this invention) | Nd 14 | 31 | 27 | 20 | 8 | — | 11.5 | 5.0 | 32.0 | 90 | −0.05 | 0.02 |
| Sample No. 10 (this invention) | Nd 25 | 31 | 27 | 9 | 8 | — | 6.5 | 10.8 | 10.0 | 91 | −0.05 | 0.01 |
| Sample No. 13 (this invention) | Nd 15 | 38 | 32 | 10 | 5 | — | 12.1 | 4.5 | 30.0 | 88 | −0.05 | 0.01 |
| Sample No. 14 (this invention) | Nd 15 | 39 | 23 | 15 | 8 | — | 12.0 | 5.0 | 30.0 | 90 | −0.06 | 0.01 |
| Sample No. 15 (this invention) | Nd 15 | 31 | 31 | 15 | 8 | — | 12.2 | 6.2 | 32.0 | 90 | −0.05 | 0.01 |
| Sample No. 16 (this invention) | Nd 14 | 27 | 39 | 12 | 8 | — | 12.5 | 7.2 | 33.0 | 90 | −0.04 | 0.01 |
| Sample No. 17 (this invention) | Nd 14 | 37 | 31 | 10 | 8 | — | 12.7 | 6.5 | 32.0 | 90 | −0.05 | 0.01 |
| Sample No. 19 (this invention) | Nd 15 | 43 | 24 | 10 | 8 | — | 12.4 | 6.2 | 31.6 | 90 | −0.06 | 0.01 |
| Sample No. 21 (this invention) | Nd 15 | 27 | 30 | 20 | 8 | — | 11.5 | 5.5 | 29.0 | 89 | −0.05 | 0.01 |
| Sample No. 23 (this invention) | Nd 15 | 23 | 27 | 27 | 8 | — | 10.5 | 4.7 | 22.5 | 90 | −0.06 | 0.01 |
| Sample No. 24 (this invention) | Nd 15 | 21 | 27 | 29 | 8 | — | 10.0 | 4.6 | 20.5 | 90 | −0.06 | 0.01 |
| Sample No. 25 (this invention) | Nd 15 | 34 | 29 | 9 | 13 | — | 10.5 | 6.4 | 24.5 | 90 | −0.05 | 0.01 |
| Sample No. 26 (this invention) | Nd 15 | 31 | 25 | 10 | 19 | — | 7.6 | 6.4 | 12.5 | 89 | −0.06 | 0.01 |
| Sample No. 28 (this invention) | Nd 12 Dy 3 | 36 | 31 | 10 | 8 | — | 10.5 | 8.5 | 25.5 | 90 | −0.05 | 0.01 |
| Sample No. 30 (this invention) | Pr 15 | 37 | 25 | 15 | 8 | — | 11.0 | 5.4 | 26.8 | 90 | −0.06 | 0.01 |
| Sample No. 32 (this invention) | Nd 5 Ce 6 Pr 2 Dy 2 | 36 | 31 | 10 | 8 | — | 11.0 | 6.7 | 27.0 | 90 | −0.05 | 0.01 |
| Sample No. 34 (this invention) | Nd 15 | 34.5 | 31 | 10 | 9 | Mg 1.5 | 11.3 | 7.8 | 31.5 | 90 | −0.03 | 0.01 |
| Sample No. 35 (this invention) | Nd 14 | 37 | 25 | 12 | 6 | Al 6.0 | 10.8 | 6.4 | 26.2 | 90 | −0.08 | 0.01 |
| Sample No. 36 (this invention) | Nd 15 | 43 | 23 | 10 | 7 | Al 2.0 | 12.1 | 6.3 | 32.8 | 91 | −0.06 | 0.01 |
| Sample No. 37 (this invention) | Nd 15 | 34.5 | 31 | 10 | 8 | Si 1.5 | 11.4 | 9.0 | 32.5 | 90 | −0.03 | 0.01 |
| Sample No. 38 (this invention) | Nd 12 Ce 1 Pr 2 | 44 | 22 | 9 | 8 | Ca 2.0 | 12.0 | 7.2 | 34.0 | 90 | −0.06 | 0.01 |
| Sample No. 39 (this invention) | Nd 16 | 33 | 31.5 | 10 | 8 | Ti 1.5 | 11.2 | 7.7 | 31.0 | 90 | −0.03 | 0.01 |
| Sample No. 40 (this invention) | Nd 5 Ce 6 Pr 2 Dy 2 | 35 | 30 | 10 | 8 | V 2.0 | 10.8 | 7.2 | 27.0 | 90 | −0.05 | 0.01 |
| Sample No. 42 (this invention) | Nd 15 | 36 | 30.5 | 9 | 8 | Mn 1.5 | 11.2 | 7.3 | 31.0 | 90 | −0.03 | 0.01 |
| Sample No. 43 (this invention) | Nd 12 Dy 3 | 35 | 30 | 10 | 8 | Cu 2.0 | 10.5 | 9.0 | 25.0 | 90 | −0.05 | 0.01 |
| Sample No. 44 (this invention) | Nd 15 | 42 | 23 | 10 | 6 | Zn 4.0 | 10.8 | 5.8 | 25.2 | 91 | −0.07 | 0.01 |
| Sample No. 45 (this invention) | Nd 15 | 40 | 21 | 10 | 6 | Ga 8.0 | 10.7 | 6.6 | 23.8 | 90 | −0.07 | 0.01 |
| Sample No. 46 (this invention) | Nd 15 | 43 | 23 | 10 | 7 | Ga 2.0 | 11.9 | 6.4 | 32.4 | 90 | −0.08 | 0.01 |
| Sample No. 47 (this invention) | Nd 15 | 34.5 | 31 | 10 | 8 | Ge 1.5 | 11.3 | 7.7 | 31.5 | 89 | −0.03 | 0.01 |
| Sample No. 48 (this invention) | Nd 12 | 46 | 22.5 | 9 | 7 | Zr 3.5 | 11.7 | 5.7 | 31.5 | 91 | −0.06 | 0.01 |
| Sample No. 49 (this invention) | Nd 15 | 34.5 | 31 | 10 | 8 | Nb 1.5 | 11.2 | 8.5 | 31.0 | 92 | −0.03 | 0.01 |
| Sample No. 50 | Nd 15 | 34.5 | 31 | 10 | 8 | Mo 1.5 | 11.2 | 8.0 | 31.0 | 91 | −0.03 | 0.01 |

TABLE 1-continued

| | Composition (at %) | | | | | | Magnetic properties | | | | | Oxidation |
|---|---|---|---|---|---|---|---|---|---|---|---|---|
| | RE | Fe | Co | Ni | B | Additional metal | Br (kG) | iHc (kOe) | (BH) max (MGOe) | SR (%) | ΔB/B (%/°C.) | increase (mg/cm²) |
| (this invention) | | | | | | | | | | | | |
| Sample No. 51 (this invention) | Nd 15 | 43 | 23 | 10 | 7 | In 2.0 | 11.0 | 6.3 | 27.0 | 90 | −0.07 | 0.01 |
| Sample No. 52 (this invention) | Nd 15 | 43 | 23 | 10 | 7 | Sn 2.0 | 10.7 | 4.3 | 22.1 | 90 | −0.07 | 0.01 |
| Sample No. 53 (this invention) | Nd 15 | 34.5 | 31 | 10 | 8 | Ta 1.5 | 11.2 | 7.8 | 31.0 | 90 | −0.03 | 0.01 |
| Sample No. 54 (this invention) | Nd 15 | 34.5 | 31 | 10 | 8 | W 1.5 | 11.2 | 8.0 | 31.0 | 92 | −0.03 | 0.01 |
| Sample No. 55 (this invention) | Nd 15 | 37 | 25 | 13 | 7 | Al 1.0 Ga 2.0 | 10.9 | 6.4 | 25.9 | 91 | −0.08 | 0.01 |
| Sample No. 56 (this invention) | Nd 15 | 40 | 22 | 10 | 7 | Al 1.0 In 1.0 Ga 2.0 Zn 2.0 | 10.6 | 5.6 | 24.2 | 90 | −0.07 | 0.01 |
| Sample No. 57 (this invention) | Nd 15 | 33 | 31 | 10 | 8 | Nb 1.5 Si 1.5 | 11.0 | 11.5 | 30.0 | 92 | −0.03 | 0.01 |
| Sample No. 58 (this invention) | Nd 15 | 33 | 31 | 10 | 8 | Mo 1.5 Si 1.5 | 11.0 | 11.0 | 30.0 | 92 | −0.03 | 0.01 |
| Sample No. 59 (this invention) | Nd 15 | 33 | 31 | 10 | 8 | Ta 1.5 Si 1.5 | 11.0 | 10.5 | 30.0 | 92 | −0.03 | 0.01 |
| Sample No. 60 (this invention) | Nd 15 | 31 | 32 | 11 | 7 | Al 2.0 In 2.0 | 10.1 | 5.9 | 22.3 | 91 | −0.06 | 0.01 |
| Sample No. 61 (this invention) | Nd 15 | 33 | 31 | 10 | 8 | W 1.5 Si 1.5 | 11.0 | 11.0 | 30.0 | 92 | −0.03 | 0.01 |
| Sample No. 62 (this invention) | Nd 15 | 32 | 29 | 10 | 6 | Al 1.0 In 1.0 Ga 4.0 Sn 2.0 | 10.0 | 6.4 | 21.6 | 91 | −0.07 | 0.01 |
| Sample No. 63 (this invention) | Nd 15 | 34 | 31 | 9 | 8 | Nb 1.0 W 1.0 | 11.0 | 11.0 | 30.0 | 92 | −0.03 | 0.01 |
| Sample No. 64 (this invention) | Nd 15 | 34 | 30 | 9 | 8 | Nb 1.0 Ta 1.0 Si 2.0 | 11.0 | 12.0 | 30.0 | 92 | −0.03 | 0.01 |
| Sample No. 65 (this invention) | Nd 15 | 34 | 30 | 9 | 8 | Nb 1.0 W 1.0 Ta 1.0 Si 1.0 | 11.0 | 12.5 | 30.0 | 92 | −0.03 | 0.01 |
| Sample No. 66 (this invention) | Nd 15 | 38 | 25 | 10 | 7 | Ga 2.0 Zn 2.0 | 10.4 | 6.0 | 23.1 | 90 | −0.06 | 0.01 |
| Sample No. 67 (this invention) | Nd 12 Y 3 | 31 | 26 | 20 | 8 | — | 10.8 | 4.3 | 24.0 | 91 | −0.05 | 0.02 |
| Sample No. 68 (this invention) | Nd 10 Y 5 | 30 | 32 | 15 | 8 | — | 11.5 | 4.7 | 27.0 | 90 | −0.05 | 0.01 |
| Sample No. 69 (this invention) | Nd 23 | 30.5 | 27 | 10 | 8 | Nb 1.0 Si 0.5 | 7.5 | 14.0 | 13.5 | 91 | −0.06 | 0.01 |
| Sample No. 70 (this invention) | Nd 14 | 30 | 26 | 9 | 19 | Ta 2.0 | 8.8 | 12.0 | 18.5 | 90 | −0.06 | 0.01 |
| Sample No. 71 (this invention) | Nd 12 Dy 3 | 17 | 50 | 9 | 8 | W 1.0 | 10.0 | 13.0 | 22.5 | 91 | −0.03 | 0.01 |
| Sample No. 73 (this invention) | Nd 10 Y 5 | 31.5 | 15 | 28 | 8 | Ta 1.0 Si 1.5 | 8.0 | 6.0 | 15.0 | 90 | −0.08 | 0.01 |
| Comparative | | | | | | | | | | | | |
| sample No. 1 | Nd 15 | 77 | — | — | 8 | — | 14.0 | 11.0 | 45.0 | 92 | −0.12 | 1.3 |
| sample No. 2 | Nd 15 | 63 | 10 | 4 | 8 | — | 13.0 | 9.0 | 35.5 | 91 | −0.10 | 1.1 |
| sample No. 3 | Nd 15 | 26 | 20 | 31 | 8 | — | 7.3 | 2.5 | 10.0 | 90 | −0.07 | 0.01 |
| sample No. 4 | Nd 14 | 9 | 30 | 40 | 7 | — | 5.8 | 1.8 | 6.0 | 92 | −0.05 | 0.01 |
| sample No. 5 | Nd 15 | 51 | 3 | 23 | 8 | — | 12.0 | 3.5 | 18.9 | 90 | −0.11 | 0.01 |
| sample No. 6 | Nd 15 | 13 | 51 | 10 | 8 | Ge 3.0 | 8.8 | 3.7 | 17.0 | 90 | −0.03 | 0.01 |
| sample No. 7 | Nd 15 | 5 | 70 | 2 | 8 | — | 7.0 | 2.5 | 9.0 | 90 | −0.03 | 0.2 |
| sample No. 8 | Nd 9 | 39 | 34 | 11 | 7 | — | 2.5 | 0.5 | 0.3 | 88 | −0.05 | 0.01 |
| sample No. 9 | Nd 2 | 52 | 24 | 12 | 10 | — | 1.0 | 0.1 | 0.1 | 89 | −0.06 | 0.01 |
| sample No. 10 | Nd 26 | 31 | 26 | 8 | 9 | — | 5.1 | 9.3 | 6.0 | 91 | −0.06 | 0.01 |
| sample No. 11 | Nd 42 | 28 | 10 | 10 | 10 | — | 0.8 | 8.8 | 0.4 | 90 | −0.10 | 0.01 |
| sample No. 12 | Nd 15 | 50 | 25 | 9 | 1 | — | 0.9 | 0.4 | 0.2 | 75 | −0.06 | 0.01 |
| sample No. 13 | Nd 15 | 41 | 12 | 10 | 22 | — | 7.1 | 6.2 | 13.0 | 93 | −0.09 | 0.01 |
| sample No. 14 | Nd 15 | 39 | 20 | 10 | 6 | Ga 10 | 9.9 | 5.8 | 19.1 | 87 | −0.08 | 0.01 |
| sample No. 15 | Nd 15 | 39 | 20 | 10 | 7 | Al 9 | 9.6 | 5.1 | 18.0 | 87 | −0.09 | 0.01 |
| sample No. 16 | Nd 15 | 39 | 20 | 10 | 7 | In 9 | 9.3 | 2.8 | 14.3 | 86 | −0.09 | 0.01 |
| sample No. 17 | Nd 15 | 39 | 20 | 10 | 7 | Zn 9 | 8.9 | 2.1 | 12.3 | 87 | −0.09 | 0.01 |
| sample No. 18 | Nd 15 | 26 | 31 | 10 | 8 | Mg 10 | 9.2 | 4.2 | 16.1 | 87 | −0.08 | 0.01 |
| sample No. 19 | Nd 15 | 26 | 31 | 10 | 8 | Si 10 | 9.0 | 4.0 | 15.9 | 87 | −0.07 | 0.01 |
| sample No. 20 | Nd 15 | 26 | 31 | 10 | 8 | Ti 10 | 9.1 | 4.1 | 16.2 | 88 | −0.07 | 0.01 |
| sample No. 21 | Nd 15 | 26 | 31 | 10 | 8 | V 10 | 9.2 | 4.2 | 16.5 | 87 | −0.08 | 0.01 |
| sample No. 22 | Nd 15 | 26 | 31 | 10 | 8 | Cr 10 | 9.0 | 3.9 | 16.0 | 88 | −0.08 | 0.01 |
| sample No. 23 | Nd 15 | 26 | 31 | 10 | 8 | Mn 10 | 9.1 | 3.8 | 16.1 | 88 | −0.09 | 0.01 |
| sample No. 24 | Nd 15 | 26 | 31 | 10 | 8 | Cu 10 | 9.2 | 4.0 | 16.5 | 88 | −0.08 | 0.01 |
| sample No. 25 | Nd 15 | 26 | 31 | 10 | 8 | Ge 10 | 9.0 | 4.2 | 16.0 | 87 | −0.08 | 0.01 |
| sample No. 26 | Nd 15 | 26 | 31 | 10 | 8 | Zr 10 | 9.2 | 4.1 | 16.5 | 87 | −0.07 | 0.01 |
| sample No. 27 | Nd 15 | 26 | 31 | 10 | 8 | Nb 10 | 9.2 | 4.2 | 16.5 | 87 | −0.07 | 0.01 |
| sample No. 28 | Nd 15 | 26 | 31 | 10 | 8 | Mo 10 | 9.1 | 4.0 | 16.2 | 87 | −0.08 | 0.01 |
| sample No. 29 | Nd 15 | 26 | 31 | 10 | 8 | Ta 10 | 9.2 | 4.1 | 16.5 | 88 | −0.09 | 0.01 |
| sample No. 30 | Nd 15 | 26 | 31 | 10 | 8 | W 10 | 9.0 | 3.8 | 15.8 | 87 | −0.09 | 0.01 |
| sample No. 31 | Nd 15 | 30 | 26 | 8 | 10 | Si 5.0 W 6.0 | 8.8 | 3.0 | 13.0 | 88 | −0.06 | 0.01 |

TABLE 1-continued

| | Composition (at %) | | | | | | Magnetic properties | | | | | Oxidation |
|---|---|---|---|---|---|---|---|---|---|---|---|---|
| | RE | Fe | Co | Ni | B | Additional metal | Br (kG) | iHc (kOe) | (BH) max (MGOe) | SR (%) | ΔB/B (%/°C.) | increase (mg/cm²) |
| sample No. 32 | Pr 17 | 36 | 24 | 5 | 8 | Cu 10 | 9.2 | 2.4 | 9.3 | 81 | −0.08 | 0.1 |

EXAMPLE 2

Each of alloy ingots produced in the same manner as described in Example 1 was placed in a quartz tube having an orifice holes of 0.6 mmϕ, and induction-melted therein under an Ar atmosphere kept to 550 mmHg. Immediately after the melting, the melted alloy was jetted on a copper alloy wheel rotating at wheel surface velocities in the range of 10.5–19.6 m/sec under a jetting pressure of 0.2 kg/cm² to cool rapidly the molted alloy and to produce a thin ribbon having a microcrystalline structure. The resulting thin ribbon was crushed by means of a roller and then pulverized into fine particles having a size of about 100–200 μm by means of a mill. Then, the fine particles were subjected to a surface treatment with phosphoric acid, the surface-treated fine particle was kneaded together with nylon-12 powder, and the resulting homogeneous mixture was formed into a bonded magnet through an injection molding. In this injection molding, the kneading temperature was about 210° C., the injection molding temperature was 240° C. at the nozzle portion, and the injection pressure was 1,400 kg/cm². In the mixture, the magnet powder content was 92% by weight.

The following Table 2 shows the magnetic properties, Curie temperature Tc, and temperature coefficient ΔB/B of residual magnetic flux density of the resulting bonded magnets. The following Table 3 shows the corrosion resistance of some of the resulting bonded magnets and the magnetic properties thereof after the corrosion resistance test together with the magnetic properties thereof before the corrosion resistance test.

It can be seen from Tables 2 and 3 that all the magnet alloys according to the present invention have excellent magnetic properties, temperature characteristics and corrosion resistance.

TABLE 2

| | Composition (at %) | | | | | | Magnetic properties | | | | |
|---|---|---|---|---|---|---|---|---|---|---|---|
| | RE | Fe | Co | Ni | B | Additional metal | Br (kG) | iHc (kOe) | (BH) max (MGOe) | Tc (°C.) | ΔB/B (%/°C.) |
| Sample No. 77 (this invention) | Nd 14 | 45 | 26 | 10 | 5 | — | 4.3 | 14.6 | 4.4 | 562 | −0.07 |
| Sample No. 79 (this invention) | Pr 14 | 39 | 27 | 15 | 5 | — | 4.0 | 13.2 | 4.0 | 569 | −0.08 |
| Sample No. 80 (this invention) | Nd 14 | 34 | 22 | 25 | 5 | — | 4.0 | 10.8 | 4.0 | 558 | −0.09 |
| Sample No. 81 (this invention) | Nd 14 | 45 | 24 | 10 | 5 | Al 2 | 4.2 | 15.2 | 4.2 | 532 | −0.07 |
| Sample No. 83 (this invention) | Nd 14 | 45 | 24 | 10 | 5 | Ga 2 | 4.2 | 14.6 | 4.2 | 533 | −0.07 |
| Sample No. 84 (this invention) | Nd 15 | 42 | 14 | 23 | 6 | — | 4.2 | 11.8 | 4.2 | 502 | −0.10 |
| Sample No. 85 (this invention) | Nd 15 | 23 | 46 | 10 | 6 | — | 4.0 | 12.2 | 4.0 | 621 | −0.06 |
| Sample No. 88 (this invention) | Nd 10 Dy 6 | 43 | 26 | 10 | 5 | — | 4.1 | 15.3 | 4.1 | 530 | −0.08 |
| Sample No. 89 (this invention) | Nd 14 | 39 | 30 | 10 | 4 | Zn 3 | 4.2 | 11.9 | 4.2 | 548 | −0.07 |
| Sample No. 90 (this invention) | Nd 14 | 45 | 24 | 10 | 5 | In 2 | 4.1 | 12.8 | 4.1 | 521 | −0.07 |
| Comparative | | | | | | | | | | | |
| sample No. 33 | Nd 14 | 82 | — | — | 4 | — | 4.8 | 15.3 | 5.0 | 313 | −0.18 |
| sample No. 34 | Nd 14 | 59 | 20 | — | 5 | Al 2 | 4.6 | 14.4 | 4.8 | 511 | −0.11 |
| sample No. 35 | Nd 13 | 42 | 20 | 10 | 5 | Ga 10 | 3.9 | 12.8 | 3.9 | 508 | −0.11 |

TABLE 3

| | Before test | | | After test | | | |
|---|---|---|---|---|---|---|---|
| | Br (kG) | iHc (kOe) | (BH) max (MGOe) | Oxidation increase (mg/cm²) | Br (kG) | iHc (kOe) | (BH) max (MGOe) |
| Sample No. 76 (this invention) | 4.4 | 15.0 | 4.5 | 0.2 | 4.4 | 14.8 | 4.5 |
| Sample No. 77 (this invention) | 4.3 | 14.6 | 4.4 | 0.1 | 4.3 | 14.6 | 4.4 |
| Sample No. 80 (this invention) | 4.0 | 10.8 | 4.0 | 0.1 | 4.0 | 10.8 | 4.0 |
| Sample No. 81 | 4.2 | 15.2 | 4.2 | 0.0 | 4.2 | 15.2 | 4.2 |
| Comparative | | | | | | | |
| sample No. 33 | 4.8 | 15.3 | 5.0 | 2.5 | 4.2 | 14.0 | 4.3 |
| sample No. 34 | 4.6 | 14.4 | 4.8 | 1.1 | 4.1 | 13.8 | 4.0 |

As described above, the RE-(Fe,Co-,Ni)-B magnet alloy according to the present invention has corrosion resistance and temperature characteristics remarkably superior to those of a conventional Nd-Fe-B type magnet and further has magnetic properties substantially the same as those of the conventional magnet. Particularly, since the RE-(Fe,Co,Ni)-B magnet alloy according to the present invention has excellent corrosion resistance, it is not necessary to carry out a treatment, such as coating, surface treatment or the like, which is required for giving an oxidation resistance to the conventional Nd-Fe-B type magnet. Therefore, the RE-(Fe,Co,Ni)-B magnet alloy according to the present invention can be produced inexpensively and moreover the alloy has a very high reliability as an industrial material.

What is claimed is:

1. A corrosion-resistant rare earth metal-transition metal magnet alloy having a composition consisting of 10–25 at % of RE, wherein RE represents at least one metal selected from the group consisting of the rare earth elements inclusive of Y; 2–20 at % of B; and the remainder being transition metals of Fe, Co and Ni in such amounts that the amount of Fe is not less than 10 at % but less than 73 at %, that of Co is 7–50 at %, that of Ni is 9–30 at %, the total amount of Fe, Co and Ni is not less than 55 at % but less than 88 at %, and a ratio of (Co+Ni)at %/(Fe+Co+Ni)at % is more than about 40%; wherein said magnet alloy exhibits 0% rusty surface area fraction.

2. A corrosion-resistant rare earth metal-transition metal magnet alloy having a composition consisting of 10–25 at % of RE, wherein RE represents at least one metal selected from the group consisting of the rare earth elements inclusive of Y; 2–20 at % of B; not more than 8 at % of at least one metal selected from the group consisting of Mg, Al, Si, Ca, Ti, V, Cr, Mn, Cu, Zn, Ga, Ge, Zr, Nb, Mo, In, Sn, Ta and W; and the remainder being transition metals of Fe, Co and Ni in such amounts that the amount of Fe is not less than 10 at % but less than 73 at %, that of Co is 7–50 at %, that of Ni is 9–30 at %, the total amount of Fe, Co and Ni is not less than 55 at % but less than 88 at %, and a ratio of (Co+Ni)at %/(Fe+Co+Ni)at % is more than about 40%; wherein said magnet alloy exhibits 0% rusty surface area fraction.

3. The corrosion-resistant rare earth metal-transition metal magnet alloy of claim 1, wherein RE is Nd and is present in an amount of about 15 at %, B is present in an amount of about 8 at %, and the total amount of Fe, Co and Ni is about 77 at %.

4. The corrosion-resistant rare earth metal-transition metal magnet alloy of claim 3, wherein said magnet alloy exhibits 0% rusty surface area fraction.

* * * * *